US010450757B2

(12) United States Patent
McIntosh

(10) Patent No.: US 10,450,757 B2
(45) Date of Patent: Oct. 22, 2019

(54) SNOW GUARD

(71) Applicant: Andrew Christian McIntosh, Powhatan, VA (US)

(72) Inventor: Andrew Christian McIntosh, Powhatan, VA (US)

( * ) Notice: Subject to any disclaimer, the term of this patent is extended or adjusted under 35 U.S.C. 154(b) by 0 days.

(21) Appl. No.: 15/866,964

(22) Filed: Jan. 10, 2018

(65) Prior Publication Data

US 2018/0195289 A1 Jul. 12, 2018

Related U.S. Application Data

(60) Provisional application No. 62/444,405, filed on Jan. 10, 2017.

(51) Int. Cl.

| | |
|---|---|
| ***E04D 13/10*** | (2006.01) |
| ***B21D 5/16*** | (2006.01) |
| ***E04D 3/36*** | (2006.01) |

(52) U.S. Cl.

CPC ..... *E04D 13/10* (2013.01); *B21D 5/16* (2013.01); *E04D 3/3606* (2013.01)

(58) Field of Classification Search

CPC ..... E04D 13/10; E04D 3/3606; B21D 5/16
USPC ..... 52/24
See application file for complete search history.

(56) References Cited

U.S. PATENT DOCUMENTS 5,070,660 A * 12/1991 Willa ..... E04D 13/10 52/24
5,152,107 A * 10/1992 Strickert ..... E04D 13/10 52/24
5,271,194 A 12/1993 Drew
5,349,791 A * 9/1994 Zaleski ..... E04D 13/10 52/24
5,655,334 A * 8/1997 Kwiatkowski ..... E04D 13/10 52/24
6,725,623 B1 4/2004 Riddell et al.
6,834,466 B2 12/2004 Trevorrow
8,025,126 B1 9/2011 Lefavor
8,607,507 B2 12/2013 Anderson
9,243,410 B1 * 1/2016 Garber ..... E04D 13/10
10,017,356 B2 * 7/2018 Hubbard ..... B66B 7/022
2007/0245636 A1 10/2007 Ayer et al.
2009/0007514 A1 1/2009 Kassem
(Continued)

OTHER PUBLICATIONS

"System for Standing Seam Metal Roofs", Sno barricade®, Accessed on Dec. 17, 2015 http://www.snogem.com/snobarricade_clamp-on_1-inch_standard.php.

(Continued)

*Primary Examiner* — Paola Agudelo
(74) *Attorney, Agent, or Firm* — Maier & Maier, PLLC

(57) ABSTRACT

A snow guard for a standing seam metal roof, which may impede falling or melting snow and ice and may prevent gutters from being overwhelmed by falling or melting snow and ice. Such a snow guard may be fitted to the standing seams of the roof by screws or similar fasteners. The snow guard may prevent leakage through the holes created by the fasteners, may aesthetically blend into the material of the standing seam metal roof system, and may function as a base for scaffold systems. Such a snow guard may also add strength to the panels on which it is disposed. Finally, such a snow guard may also have the benefit of being easy to install.

13 Claims, 9 Drawing Sheets

(56) References Cited

U.S. PATENT DOCUMENTS

| | | | | |
|---|---|---|---|---|
| 2009/0205262 | A1* | 8/2009 | Andrew | E04D 13/10<br>52/26 |
| 2010/0133040 | A1 | 6/2010 | London | |
| 2013/0313043 | A1 | 11/2013 | Lallier | |
| 2015/0060620 | A1 | 3/2015 | Smeja | |
| 2015/0136532 | A1* | 5/2015 | Hubbard | B66B 7/022<br>187/406 |

OTHER PUBLICATIONS

"Snow Retention System", Berger E-Rail, Accessed on Dec. 17, 2015 http://www.bergerbp.com/media/doc/E-Rail_Installation.pdf.

* cited by examiner

SNOW GUARD

CLAIM OF PRIORITY

This application claims priority from U.S. Provisional Patent Application No. 62/444,405, filed on Jan. 10, 2017, entitled "SNOW GUARD," the entire contents of which are hereby incorporated by reference.

BACKGROUND

Standing seam metal roofs are often employed in roofing applications where protection and durability are paramount. They are most commonly employed on agricultural buildings, such as barns or other farm outbuildings, or on commercial buildings, such as restaurants. Standing seam metal roofs are thus typically referred to as "commercial roofing," "agricultural panel roofing," or "barn roofing." However, premium "standing seam" metal roofs often see use in residential applications.

These types of metal panel roofs are made up of narrow panels that run vertically up the roof, typically placed over a plywood or particle board substructure. These panels include raised edges running along each of the left and the right sides of the panel. To install the roof, the raised edge of each panel is placed alongside the opposite raised edge of the adjoining panel, and the panels are then coupled together by crimping or bending of the raised edges. This creates the most prominent visual features of a "standing seam" metal roof: the raised interlocking seams that are created when one panel is joined to the next.

These seams serve to create a seal between one panel and the next, preventing rainwater or other fluid from leaking through the roofing panels and seeping into the roofing substructure below the roofing panels, as well as to the area between each roofing panel. Typically, such leakage is undesirable because it leads to the substructure of the roof becoming rotted or otherwise losing structural integrity, or because it leads to visible leaks within the building.

One problem with standing seam metal roofs is that snow accumulating on them may fall in large masses. For example, heat rising from the building may melt the bottom layer of snow and slicken the interface between the accumulated snow and the metal roof, causing a significant quantity of snow to slide off all at once. This can potentially cause damage to people or property in the path of the snow.

As such, snow guards are often installed on standing seam metal roofs. These act to prevent snow from falling off of the metal roof, thereby preventing damage to people or property that might be caused by falling snow. Snow guards can be coupled to either a roofing panel of the metal roof or to the seam of the abutting roofing panels.

In the prior art, it has been found that it is undesirable to secure snow guards to standing seam metal roofs by the use of screws or bolts. This is because screws and bolts can puncture the roofing panel or seam into which they are driven, destroying the hermeticity of the metal roof, such that it no longer keeps out fluid. This enables fluid to seep into the underlying roof substructure, causing all of the attendant problems discussed above. See, for example, U.S. Pat. No. 6,834,466, "Snow Guard," issued to Trevorrow et al.

As such, attachment mechanisms for snow guards have most commonly been clamps that fit to either side of a standing seam. These clamps, however, have their own problems. Often, in order to attach firmly to the roof, the clamps act to bend or crimp the standing seam, creating a discontinuous portion, in order to prevent the clamp from sliding on the standing seam. Such bent standing seams can appear unsightly. When the snow guard is employed in an agricultural or commercial building, such as a barn, this is often less of a problem; barns and similar buildings often make use of standing seam metal roofs because of the low price or because of the protection they offer, and the aesthetics of the roof are less important. However, as mentioned, standing seam metal roofs have been seeing increasing use on residential homes, and in such applications aesthetics are typically more important.

Alternatively, the clamps used to attach the snow guard to the standing seam can be looser. However, this creates or exacerbates other problems. For example, in many cases, it may be desired to perform repairs or maintenance work on the standing seam metal roof, which may require the erection of scaffolding on the roof so that workers can access the part of the roof that needs to be repaired. It is usually desirable to couple the scaffolding to fixtures on the roof. However, a snow guard supported by a clamp system—and particularly a clamp system that is designed to clamp loosely—is not likely to offer sufficient strength to support scaffolding. This means that a snow guard that relies on a clamping system to anchor it to a standing seam metal roof may not be able to support scaffolding, and may even have to be removed in order to put the scaffolding in place.

The installation of a snow guard that makes use of any kind of clamps can also have aesthetic downsides above and apart from any aesthetic damage that may be inflicted on the roof. In most cases, the clamps will not aesthetically blend into the rest of the roof system; the thin, clean lines of the standing seams of the roof will be interrupted by the blocky nodules of the clamps used to support the snow guard, creating an undesirable visual effect.

SUMMARY

According to an exemplary embodiment, a snow guard for a standing seam metal roof may be disclosed. Such a snow guard may impede falling or melting snow and ice and may prevent gutters from being overwhelmed by falling or melting snow and ice. Such a snow guard may prevent leakage, may aesthetically blend into the material of the standing seam metal roof system without the risk of deformation of the standing seam metal roof system, and may function as a base for scaffold systems. Such a snow guard may add strength to the panels on which it is disposed. Lastly, such a snow guard may also have the benefit of being easy to install.

According to an exemplary embodiment, a snow guard attachable to a raised portion of a building surface may be formed so as to include an upper base plate, the upper base plate optionally having a thickened edge portion formed from the material of the upper base plate and disposed along an upper edge of the upper base plate. (For example, according to an exemplary embodiment in which the material of the upper base plate is sheet metal, the material of the thickened edge portion may be a piece of sheet metal that has been bent over itself one or more times using an appropriate sheet metal bending technique, such as, for example, beading of the sheet metal with a single die or otherwise, hemming of the sheet metal to have a flat hem or open hem, hemming the sheet metal multiple times to have a double-hem edge or multiple-hem edge, or otherwise bending or forming the sheet metal.) In an embodiment, the upper base plate may further have a flange connection to an upper barrier plate disposed along a lower edge of the upper base plate.

According to an exemplary embodiment, the upper barrier plate may be formed from a first raised portion extending from the flange connection of the upper base plate at a first angle with a length of the upper base plate, and a second raised portion having a flange connection to a lower base plate disposed along a lower edge of the second raised portion and extending from the flange connection of the lower base plate at a second angle with a length of the lower base plate, the second raised portion terminating in a flange connection to a lower barrier plate and further having a rounded edge connecting the second raised portion to the first raised portion. In an embodiment, the rounded edge may bridge the first raised portion and the second raised portion, which may for example each be connected to it; in another exemplary embodiment, the rounded edge may be contiguous with one or the other of the first raised portion and the second raised portion, or neither, and may be installed over either or both of the first raised portion and the second raised portion. (In an exemplary embodiment, the snow guard may be constructed as a single part, or not, as may be desired. Parts may be connected at, for example, the upper barrier plate, where they may be connected, for example, by crimping or by a connector, or may be connected elsewhere or through another method such as may be desired. For example, one side of the upper barrier plate may have an open hem that may be crimped, and/or the upper barrier plate may have one or more holes through which a connector may be disposed.)

According to an exemplary embodiment, the lower base plate may have a flange connection to a lower barrier plate disposed along a lower edge of the lower base plate. The lower barrier plate may extend from the flange connection of the lower base plate in a direction at a third angle to the lower base plate, and may likewise have a thickened edge portion formed from the material of the lower barrier plate and disposed along a lower edge of the lower barrier plate.

According to an exemplary embodiment, the thickened edge portion may be bent sheet metal or other material having a thickness of at least twice that of the material, such as the material of the upper base plate or the material of the lower barrier plate.

According to an exemplary embodiment, the lower base plate of the snow guard may be parallel to the upper base plate so as to seat the snow guard flush with the standing seams of the roof. In an exemplary embodiment, the barrier plates, such as the upper and lower barrier plates, may extend perpendicular to the upper base plate and the lower base plate, or may extend at some other angle, and may or may not be parallel with one another.

According to an exemplary embodiment, the snow guard may be formed by introducing a bend into the material between the lower barrier plate portion and the lower base plate portion, introducing a bend into the material between the lower base plate portion and the upper barrier plate portion, introducing a degree bend into the material to form the tip of the upper barrier plate portion, and introducing a bend into material between the upper barrier plate portion and the upper base plate portion. According to an exemplary embodiment, the material may be bent inward at either end in order to form rounded ends, if desired. In an exemplary embodiment in which the snow guard is formed from more than one piece, each of the pieces may be separately formed, such as may be desired, and may be coupled together such as may be desired.

According to an exemplary embodiment, the snow guard may be installed by aligning the lower base plate and upper base plate along a standing seam of the roof and installing one or more connectors such that they go through the upper base plate and/or the lower base plate and into the standing seam. In an exemplary embodiment, one or more other connectors, such as a connector through the upper barrier plate, may further be applied.

In an exemplary embodiment, the snow guard may have additional bends or reinforced portions, or may be optionally configured to have additional bendable or reinforceable portions in order to provide adjustability to the height of the snow guard. For example, according to an exemplary embodiment, a snow guard may be provided with a reinforced flange in one or more areas of the snow guard, such as on a lower barrier plate or elsewhere (such as, for example, on an upper barrier plate) which may provide further reinforcement to this element of the snow guard. According to an exemplary embodiment, a user may be able to install the snow guard and then adjust the reinforced flange by bending the reinforced flange until it is at a desired position and the snow guard has a desired height, which may allow the same size of snow guard to be used on multiple sizes of standing seam, such as both one-inch and one-and-one-half inch sizes, such as may be desired.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Figure 1:
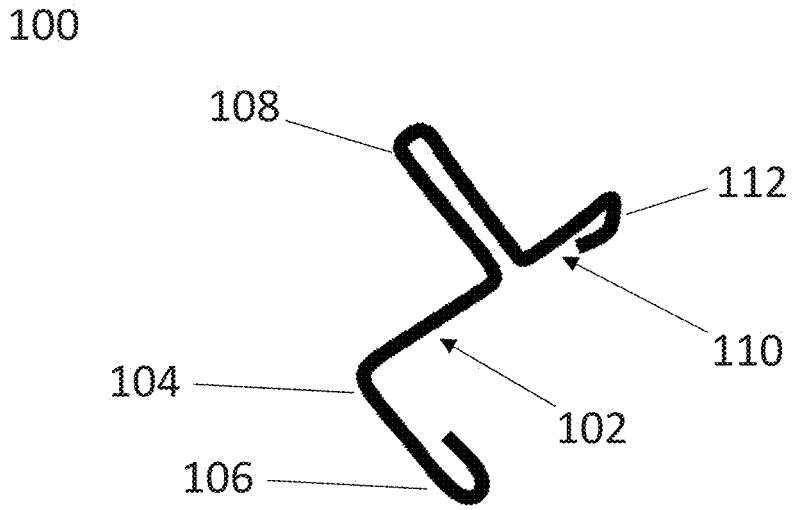
FIG. 1 is an exemplary embodiment of a snow guard, shown in a profile view.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring generally to the Figures, various exemplary implementations of a snow guard may be disclosed. According to an exemplary embodiment, such a snow guard may be installed on any building featuring a standing seam metal roof, such as a residential building, commercial building, or agricultural outbuilding.

According to an exemplary embodiment, a snow guard may function to impede snow and ice from suddenly falling off of the roof, which may prevent damage to people or property that are under the roof when the snow or ice falls off. Such a snow guard may likewise function to constrain the rate at which water from melting snow or ice, or other liquids, may drain off of the roof, mitigating damage that might be caused by excessive liquid flow volume from the roof. Likewise, according to an exemplary embodiment, a snow guard may function to prevent gutters from being overwhelmed by falling or melting snow and ice.

According to an exemplary embodiment, such a snow guard may prevent leakage of liquid through the roof, while still making use of screws, bolts, or other such fasteners to couple the snow guard onto the roof. This may ensure that the snow guard is coupled sufficiently strongly to the roof to allow the snow guard to be used as a base for a scaffolding system, should it be necessary to install one on the roof. This may also make the snow guard easy to install. Finally, this may also ensure the snow guard can be coupled to the standing seam metal roof without requiring the use of large, bulky clamps, ensuring that the standing seam metal roof has a desirable aesthetic effect.

According to an exemplary embodiment, a snow guard may be constructed from a similar material to the standing seam metal roof, such as steel or aluminum; in another exemplary embodiment, the snow guard may be constructed from the same material. In another exemplary embodiment, the snow guard may be constructed from a material that gives the same visual effect as the material used to construct the standing seam metal roof when both are painted.

Turning now to exemplary FIG. 1, FIG. 1 displays an exemplary embodiment of a snow guard 100, herein shown in a profile view. According to an exemplary embodiment, a snow guard 100 may include a lower base plate 102, to which is connected a lower barrier plate 104 and an upper barrier plate 108. Upper barrier plate 108 may be connected to an upper base plate 110. In an exemplary embodiment, each of the upper barrier plate 108 and the lower barrier plate 104 may extend parallel to one another and perpendicular to both the lower base plate 102 and the upper base plate 110. In other exemplary embodiments, one or more of the upper barrier plate 108, the lower barrier plate 104, the lower base plate 102, and the upper base plate 110 may be formed at a different angle; for example, according to an exemplary embodiment, one or both of the upper barrier plate 108 and the lower barrier plate 104 may be turned slightly inward, such that an acute angle is formed between the lower barrier plate 104 and the lower base plate 102, or between the upper barrier plate 108 and the upper base plate 110.

According to an exemplary embodiment, the snow guard 100 may be formed from a single piece of material, which may be, for example, the same type of sheet metal from which the standing seam metal roof has been formed. According to an exemplary embodiment, the snow guard 100 may be formed by introducing a bend into the material between the lower barrier plate 104 portion and the lower base plate 102 portion, introducing a bend into the material between the lower base plate 102 portion and the upper barrier plate 108 portion, introducing a 180 degree bend into the material to form the tip of the upper barrier plate 108 portion, and introducing a bend into material between the upper barrier plate 108 portion and the upper base plate 110 portion. According to an exemplary embodiment, the material may be bent inward at either end 106, 112 in order to form rounded ends, if desired. For example, according to an exemplary embodiment, a 180 degree bend may be introduced near the lowermost end of the material 106 so that the lowermost end of the material 106 rests against the lower barrier plate 104, and a 180 degree bend may be introduced near the uppermost end of the material 112 so that the uppermost end of the material rests against the upper base plate 110.

Figure 2:
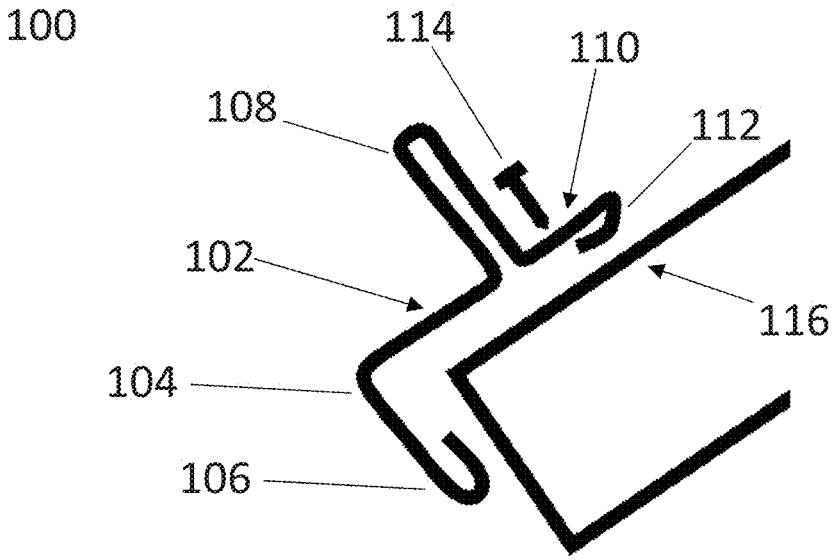
FIG. 2 is an exemplary embodiment of a snow guard, shown in a profile view.

Turning now to exemplary FIG. 2, FIG. 2 displays an exemplary embodiment of a snow guard 100, and further displays an exemplary embodiment of a standing seam 116 to which the snow guard 100 may be coupled and a fastener 114 that may be used to couple the snow guard 100 to the standing seam 116. According to an exemplary embodiment, each of the lower base plate 102 and the upper base plate 110 may be disposed on the top of the standing seam 116, such that at least a portion of each of the lower base plate 102 and the upper base plate 110 rests on the top of the standing seam 116.

The lower barrier plate 104 may be disposed such that the end of the lower barrier plate 106 extends outward past the standing seam 116. In an exemplary embodiment, the lower barrier plate 104 may be flush with the end of the standing seam 116; according to another exemplary embodiment, there may be additional space between the lower barrier plate 104 and the end of the standing seam 116. In an exemplary embodiment (such as an embodiment in which there is additional space between the lower barrier plate 104 and the end of the standing seam 116) the lower barrier plate 104 may extend all the way to the bottom of the standing seam 116; in another exemplary embodiment, the lower barrier plate 104 may extend only part of the way down the standing seam 116.

In an exemplary embodiment, the snow guard 100 may be coupled to the standing seam 116 by one or more fasteners 114, which may be disposed in, for example, the upper base plate 110, or alternatively the lower base plate 102. For example, according to an exemplary embodiment, a fastener 114, such as a screw, may be inserted through a pre-formed hole formed in the upper base plate 110, and from there, into the standing seam 116. According to an exemplary embodiment, the one or more fasteners 114 may be, for example, stainless steel grommeted screws, which may be resistant to corrosion. In other exemplary embodiments, the one or more fasteners 114 may be any other type of fastener such as may be desired. According to an exemplary embodiment, the snow guard 100 may be coupled to each standing seam 116 crossed by the snow guard 100 in this way; according to another exemplary embodiment, the snow guard 100 may be coupled to only a fraction of the standing seams 116 on which it rests, or may be coupled differently to different standing seams 116.

Figure 3:
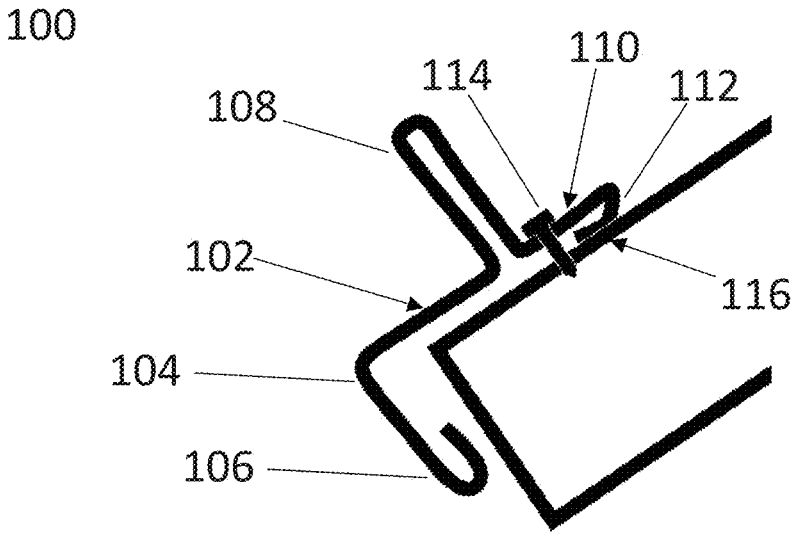
FIG. 3 is an exemplary embodiment of a snow guard, shown in a profile view.

Turning now to exemplary FIG. 3, FIG. 3 displays an exemplary embodiment of a snow guard 110, as actually coupled to a standing seam 116 by a fastener 114. As shown, according to an exemplary embodiment, a fastener 114 may be inserted through the upper base plate 110 and into the standing seam 116.

Figure 4:
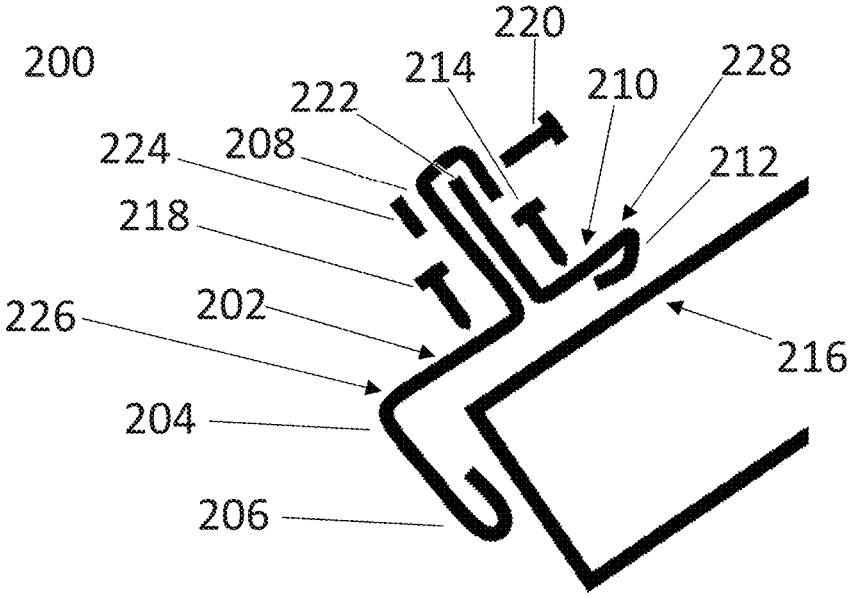
FIG. 4 is an exemplary embodiment of a snow guard, shown in a profile view.

Turning now to exemplary FIG. 4, FIG. 4 displays an alternative exemplary embodiment of a snow guard 200. According to an exemplary embodiment, a snow guard 200 may be formed from multiple pieces, such as a first piece 226 and a second piece 228. According to an exemplary embodiment, a first piece 226 may feature a lower base plate 202, and a second piece 228 may feature an upper base plate 210. In an exemplary embodiment, these pieces 226, 228 may couple at the upper barrier plate 208, 222, or may couple at any other point, as desired.

According to an exemplary embodiment, the lower base plate 202 of a first piece 226 may be connected to a lower barrier plate 204, the lower barrier plate ending in a rounded end 206, and may be connected to a portion of an upper barrier plate 208. In an exemplary embodiment, the upper base plate 210 of a second piece 228 may be connected to another portion of an upper barrier plate 222 and may terminate in a rounded end 212.

According to an exemplary embodiment, the first piece 226 portion of the upper barrier plate 208 and the second piece 228 portion of the upper barrier plate 222 may interlock. For example, according to an exemplary embodiment, the first piece 226 portion of the upper barrier plate 208 and the second piece 228 portion of the upper barrier plate 222 may fit together in a tongue-and-groove fitting, wherein the first piece 226 portion of the upper barrier plate 208 forms a groove and the second piece 228 portion of the upper barrier plate 222 forms a tongue.

In an exemplary embodiment, one or more fasteners 220 may then be placed through the upper barrier plate portions 208, 222 in order to secure the attachment of the first piece 226 to the second piece 228. For example, according to an exemplary embodiment, the first piece 226 may be secured to the second piece 228 by a fastener 220 placed at each point at which the snow guard 200 crosses a standing seam 216. In another exemplary embodiment, fasteners 220 may be provided at other points along the snow guard 200, such as intermediately between standing seams 216, if desired.

In an embodiment, such a fastener 220 may be, for example, a bolt 220 or machine screw secured by a nut 224. In another exemplary embodiment, another type of fastener 220 may be used. In another exemplary embodiment, no fastener 220 may be used, and the connection between each portion of the upper barrier plate 208, 222 may instead be crimped in order to strengthen the connection.

According to an exemplary embodiment, the snow guard 200 may be secured to a standing seam 216 by a plurality of fasteners 214, 218. According to an exemplary embodiment, one fastener may be provided for each piece at every point at which the snow guard 200 crosses a standing seam 216, such that one fastener 218 is provided through the lower base plate 202 of the first piece 226 and such that one fastener 214 is provided through the upper base plate 210 of the second piece 228. In another exemplary embodiment, fasteners 214, 218 may be provided for every other standing seam 216, or for some fraction of standing seams 216, instead of for every standing seam 216.

Figure 5:
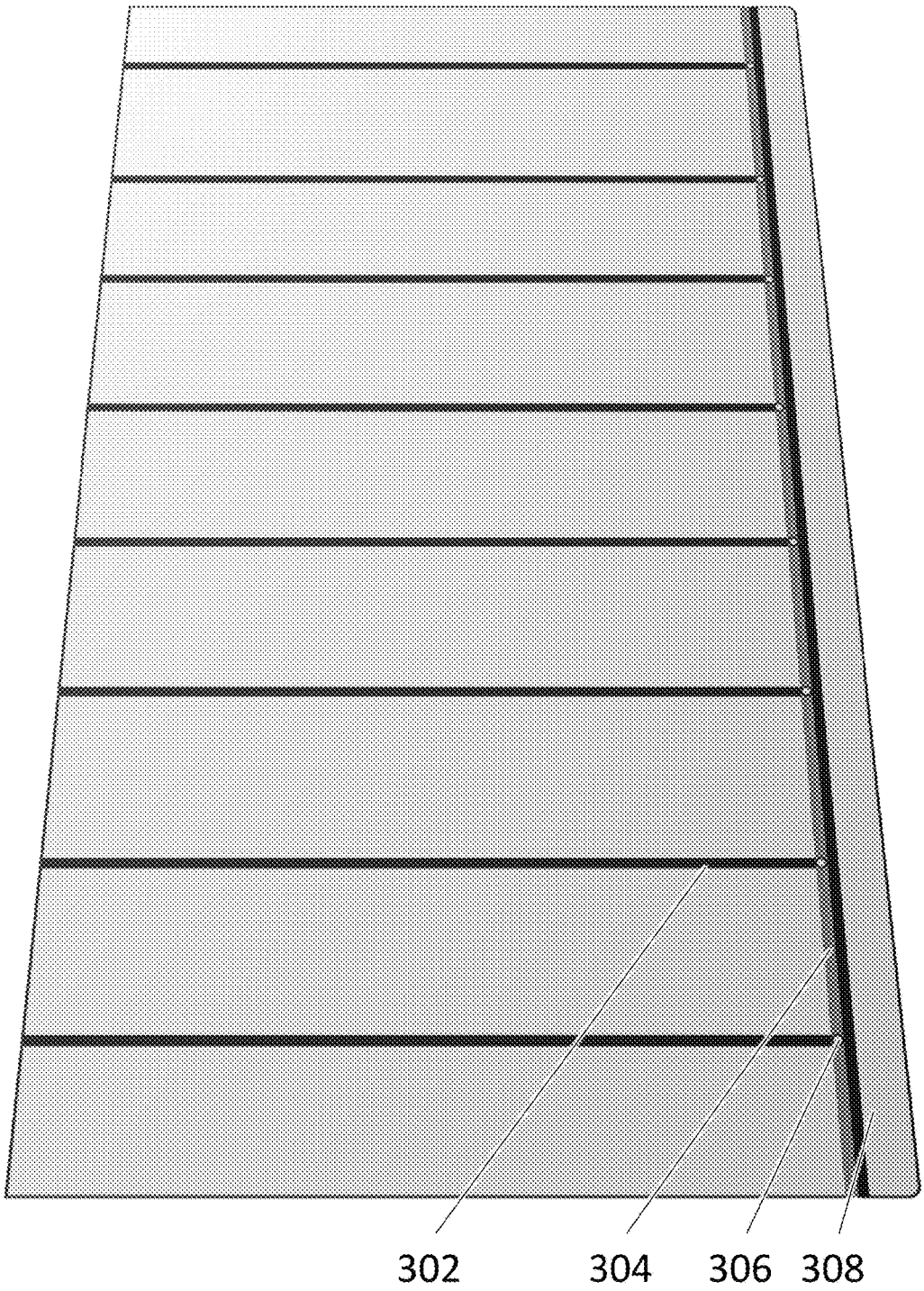
FIG. 5 is an exemplary embodiment of a snow guard as installed on a residential standing seam metal roof.

Turning now to exemplary FIG. 5, FIG. 5 displays an exemplary embodiment of a snow guard 304 as installed on a residential standing seam metal roof 300. According to an exemplary embodiment, the standing seam metal roof 300 may have a plurality of standing seams 302 protruding upwards from it. The snow guard 304 may be coupled to the standing seams 302, with one fastener 306 per standing seam 302. In an exemplary embodiment, a snow guard 304 may run parallel to, for example, a gutter 308, or to an edge of a roof or other drainage location, if desired.

Figure 6:
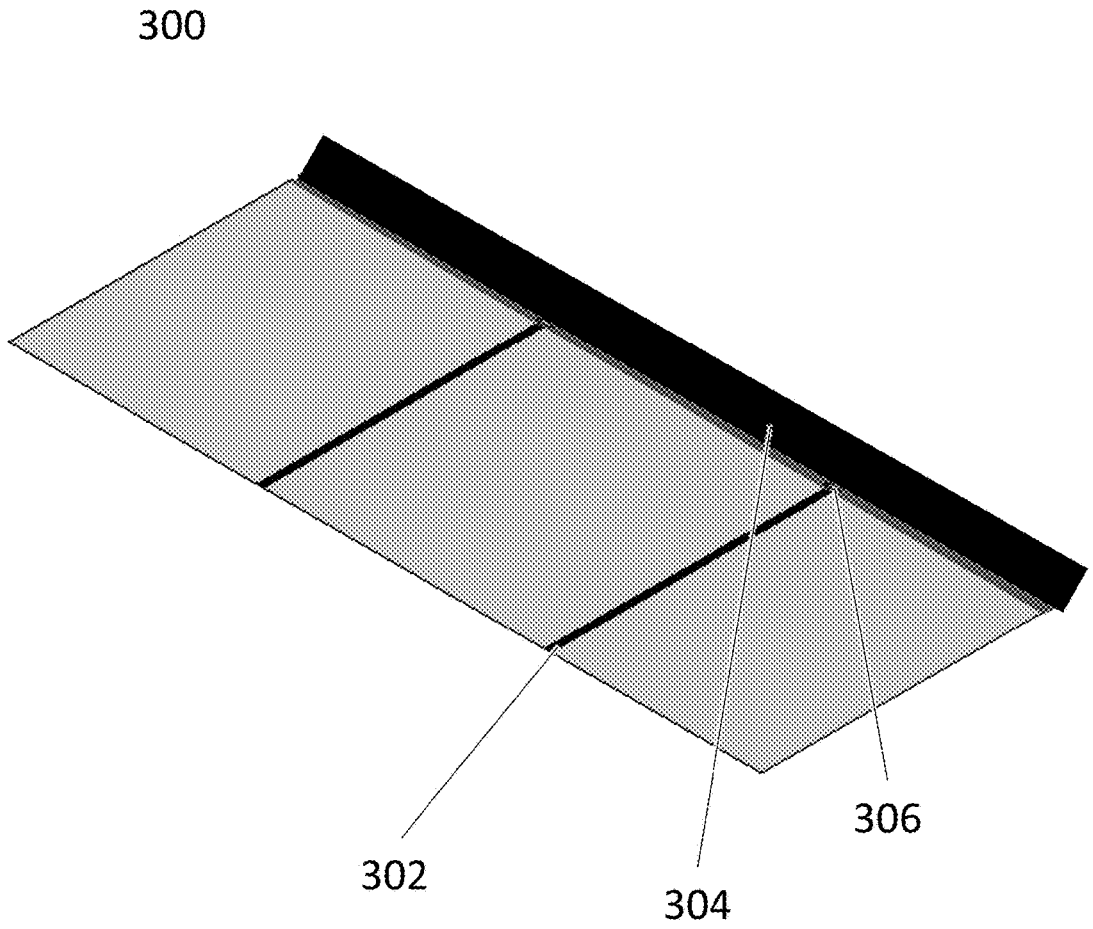
FIG. 6 is an exemplary embodiment of a snow guard as installed on a residential standing seam metal roof.

Turning now to exemplary FIG. 6, FIG. 6 displays an exemplary embodiment of a snow guard 304 as installed on a residential standing seam metal roof 300. According to an exemplary embodiment, a lower barrier plate may extend downward from the snow guard 304, and an upper barrier plate may extend upward from the snow guard 304. In an embodiment, each of the lower barrier plate and the upper barrier plate may be disposed essentially perpendicular to the surface of the standing seam metal roof 300, so as to prevent snow and ice from sliding off of the standing seam metal roof 300.

Figure 7:
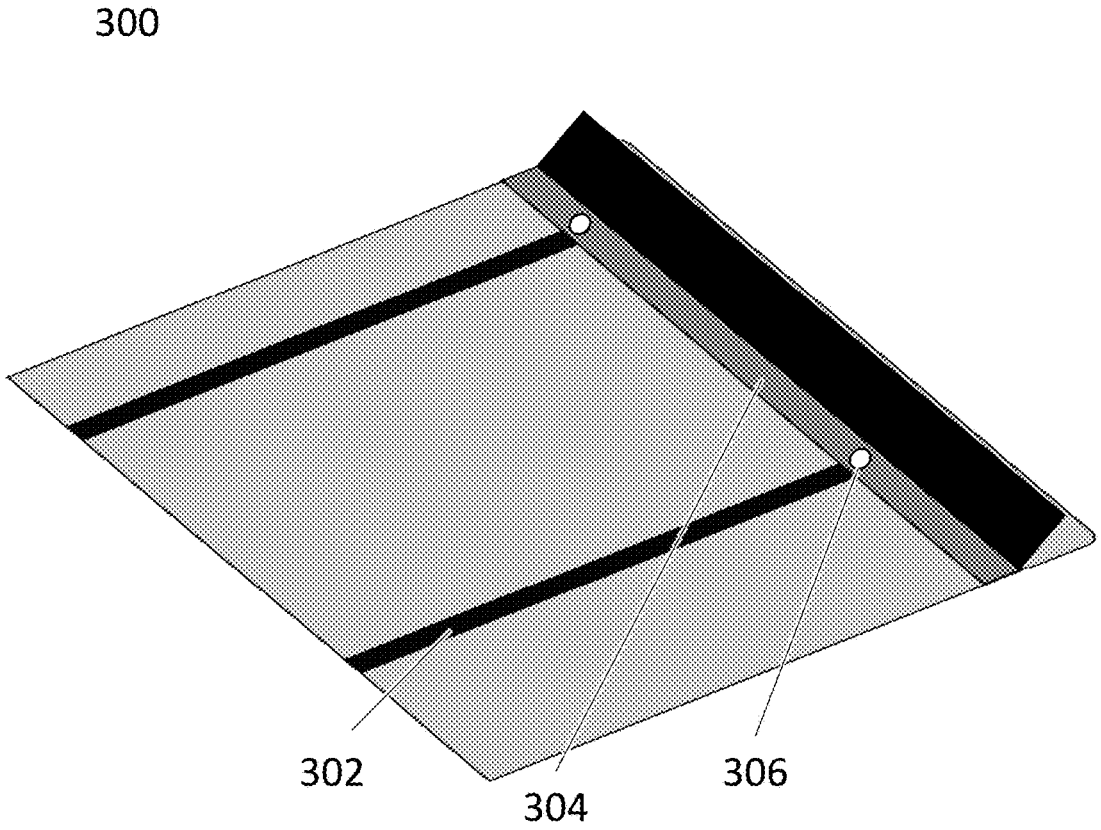
FIG. 7 is an exemplary embodiment of a snow guard as installed on a residential standing seam metal roof.

Turning now to exemplary FIG. 7, FIG. 7 displays an exemplary embodiment of a snow guard 304 as installed on a residential standing seam metal roof 300.

Figure 8:
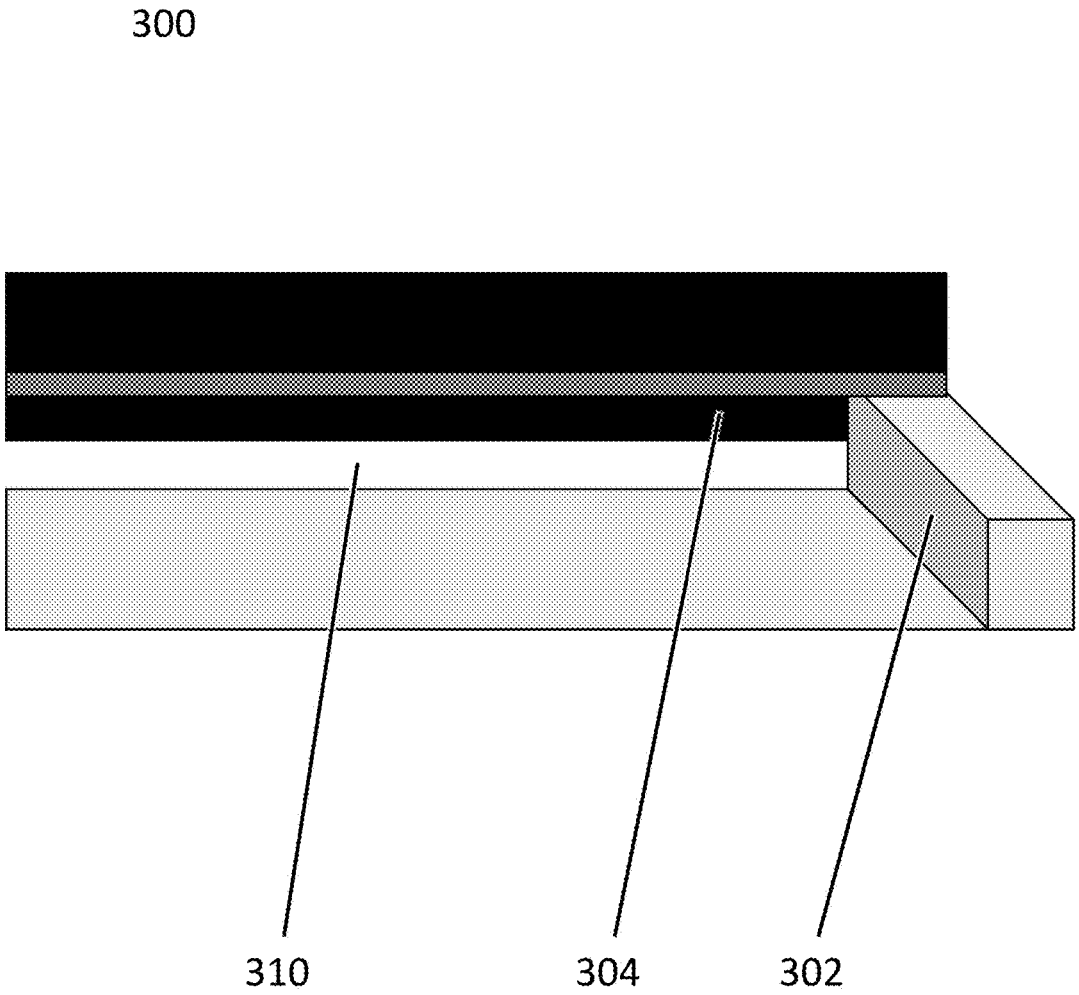
FIG. 8 is an exemplary embodiment of a snow guard as installed on a residential standing seam metal roof.

Turning now to exemplary FIG. 8, FIG. 8 displays an exemplary embodiment of a snow guard 304 as installed on a residential standing seam metal roof 300, as viewed from the top of the roof 300. According to an exemplary embodiment, a small gap 310 may be provided under the snow guard 304 to permit drainage of liquid from the snow guard 304. This may ensure that, for example, the snow guard 304 can drain melting snow and ice from the surface of the roof 300, or that the snow guard 304 can drain rainwater that falls on the roof 300.

Figure 9:
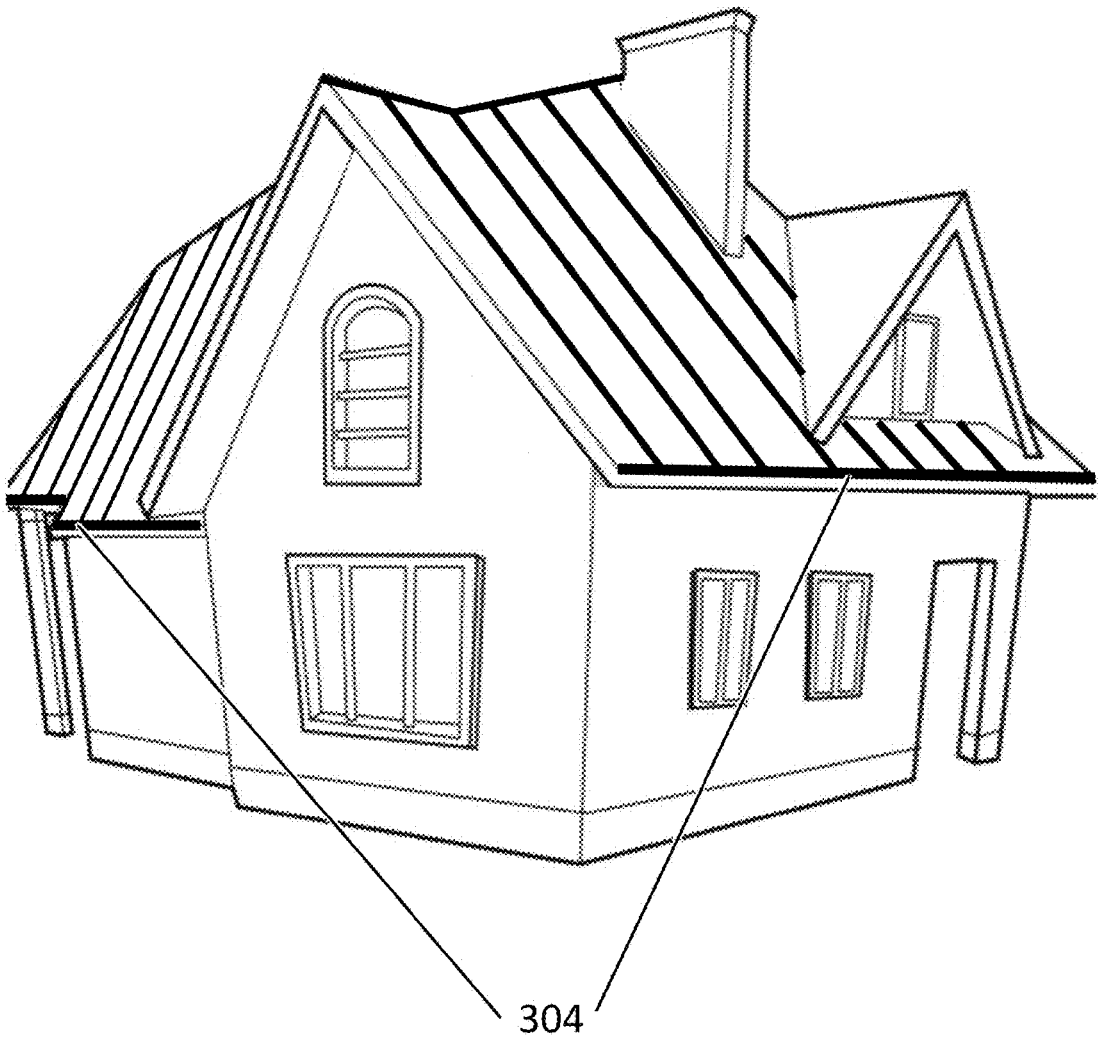
FIG. 9 is an exemplary embodiment of a snow guard as installed on a residential standing seam metal roof.

Turning now to exemplary FIG. 9, FIG. 9 displays an exemplary embodiment of a snow guard 304 as installed on a residential standing seam metal roof 300. According to an exemplary embodiment, a roof 300 may be tiered, for example having an upper first section and a lower second section; in an embodiment, a snow guard 304 may be installed on each tier of the roof 300 rather than just on the lowest tier of the roof 300.

Now referring generally to the embodiments and figures, it may be understood that a snow guard such as is provided in the foregoing disclosure may have any height, and that the height of the snow guard may be freely adjusted in order to, for example, increase the snow retention capacity of the snow guard, decrease the snow retention capacity of the snow guard (such as for structural reasons) or variably increase and decrease the snow retention capacity of the snow guard (such that the snow guard may have higher snow retention capacity in some areas and lower snow retention capacity in other areas, which may be used to, for example, distribute the load of snow retained by the snow guard across appropriate structural positions on the roof, or may be used to ensure that snow begins falling off the roof in certain areas first when the snow guard is fully loaded).

For example, according to an exemplary embodiment, a snow guard may be provided such that it has a uniform 1" (one inch) profile, i.e. such that it is one inch high. In another exemplary embodiment, a snow guard may be provided such that it has a uniform 1.5" (one and one half-inch) profile, allowing it to retain additional snow. In other exemplary embodiments, other heights may be contemplated, or variable heights may be contemplated, either in different areas of the roof or even in the same area. For example, it may in some cases be desirable to have a snow guard with a toothed upper surface pattern (for example, a WW or MM-shaped pattern) in order to reduce the likelihood of large chunks of snow falling (rather than small clumps) when a snow guard is overloaded.

In some exemplary embodiments, a snow guard may be provided so that it has a variable width or variable thickness, or otherwise uses a variable amount of material. In some exemplary embodiments, for example, it may be desirable to use the same thickness of sheet metal that was used to form the roofing panels to form a snow guard. In some other exemplary embodiments, it may be desirable to use a thicker or thinner sheet metal, or to fold the sheet metal over itself so that it is two or more layers thick in parts. Other strengthening features may also be contemplated. For example, according to an exemplary embodiment, a snow guard may be provided with additional material on a lower barrier plate, such as lower barrier plate 104, 204, which may be bent into a flanged edge or otherwise bent into a reinforced edge in order to provide further strength to the lower barrier plate element of the snow guard.

Figure 10:
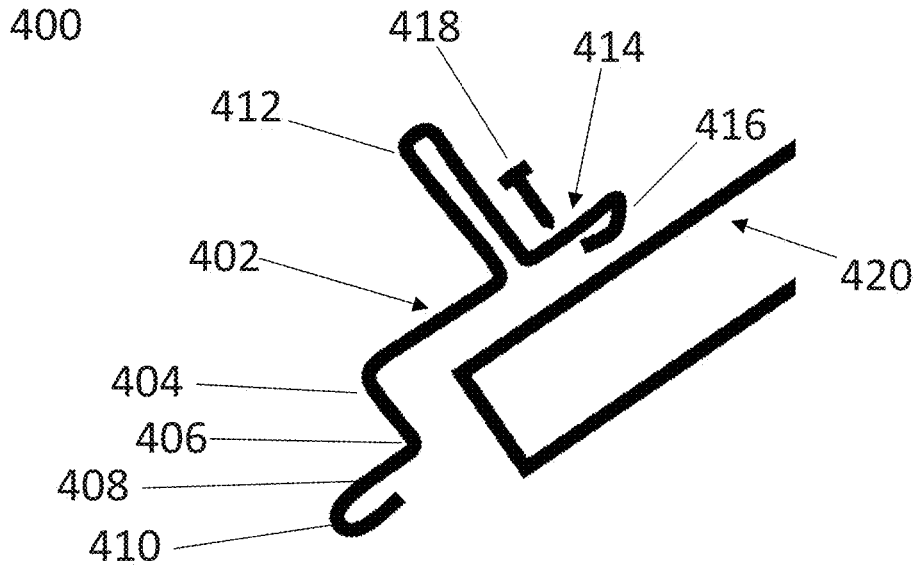
FIG. 10 is an exemplary embodiment of a snow guard, shown in a profile view.

Turning now to exemplary FIG. 10, FIG. 10 displays an alternative exemplary embodiment of a snow guard 400. According to an exemplary embodiment, a snow guard 400 may have one or more reinforced portions, such as one or more flanges 406, disposed thereon. For example, according to an exemplary embodiment, the lower base plate portion 402 of a snow guard 400 may have a lower barrier plate 404 that is provided with an outward-facing flanged corner 408 rather than an end, such as a beaded or hemmed end. According to an exemplary embodiment, the flanged corner 406 may provide the snow guard 400 with a tail 408, which may then terminate in an end 410, such as a beaded or hemmed end, such as may be desired. According to an exemplary embodiment, a snow guard 400 may then otherwise have an upper barrier plate 412, an upper base plate 414 with its own end 416, and may be coupled to a standing seam 420 with a connector 418. According to an exemplary embodiment, the standing seam 420 to which such an exemplary embodiment of a snow guard 400 may be connected may be lower than other standing seams, such as standing seam 116, to which exemplary embodiments of snow guards may be connected; for example, according to an exemplary embodiment, the standing seam 420 may be a one-inch standing seam rather than a one and one-half inch standing seam, or may be of another size such as may be desired. In other exemplary embodiment, the standing seam 420 may be of any size, and an exemplary embodiment of a snow guard 400 may incorporate any amount of material such as more material than may be present in snow guards intended to work with other standing seams, if desired.

Figure 11:
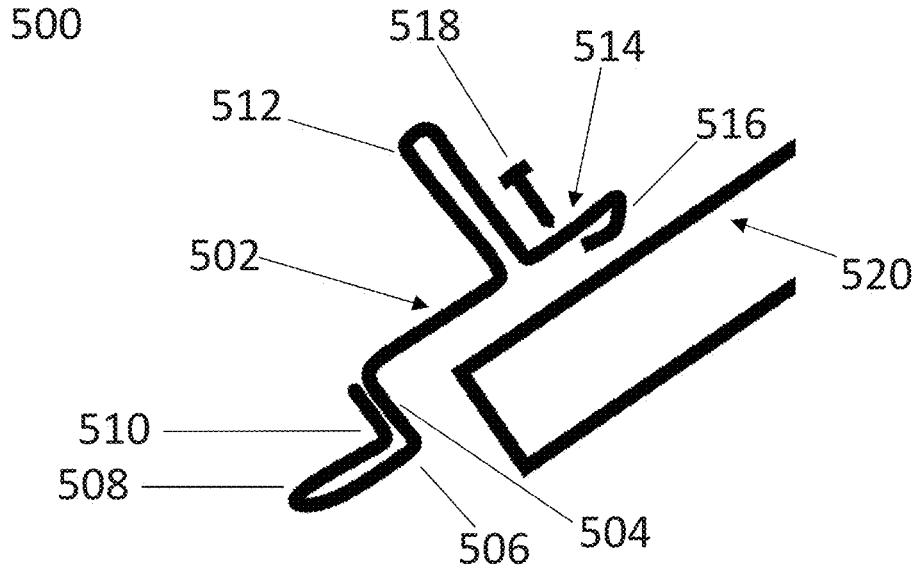
FIG. 11 is an exemplary embodiment of a snow guard, shown in a profile view.

Turning now to exemplary FIG. 11, FIG. 11 displays an alternative exemplary embodiment of a snow guard 500. According to an exemplary embodiment, a snow guard 500 may have one or more reinforced portions, such as one or more flanges 506, disposed thereon, just as in the exemplary embodiment of a snow guard 400 shown in FIG. 10. However, according to an exemplary embodiment, another form of reinforcement to that depicted in FIG. 10 may be provided. For example, according to an exemplary embodiment, it may be understood that, rather than providing a single-layered flange corner similar to the flange corner 406 of FIG. 10, a reinforced flange corner 506 having a hem extending along its length may be provided. For example, according to an exemplary embodiment, a reinforced flange corner 506 may be provided with a 180-degree bend 508, after which the material of the reinforced flange corner 506 may loop back on itself in order to strategically double the thickness of the reinforced flange corner 506 in a reinforced lower base plate area portion 510. This reinforced flanged corner 506 may likewise provide the snow guard 500 with a tail that serves to reinforce the lower base plate 504. According to an exemplary embodiment, a snow guard 500 may then otherwise have an upper barrier plate 512, an upper base plate 514 with its own end 516, and may be coupled to a standing seam 520 with a connector 518. According to an exemplary embodiment, the standing seam 520 to which such an exemplary embodiment of a snow guard 500 may be connected may be lower than other standing seams, such as standing seam 116, to which exemplary embodiments of snow guards may be connected; for example, according to an exemplary embodiment, the standing seam 520 may be a one-inch standing seam rather than a one and one-half inch standing seam (as in FIG. 10), or may be of another size such as may be desired. In other exemplary embodiment, the standing seam 520 may be of any size, and an exemplary embodiment of a snow guard 500 may incorporate any amount of material such as more material than may be present in snow guards intended to work with other standing seams, if desired.

Figure 12:
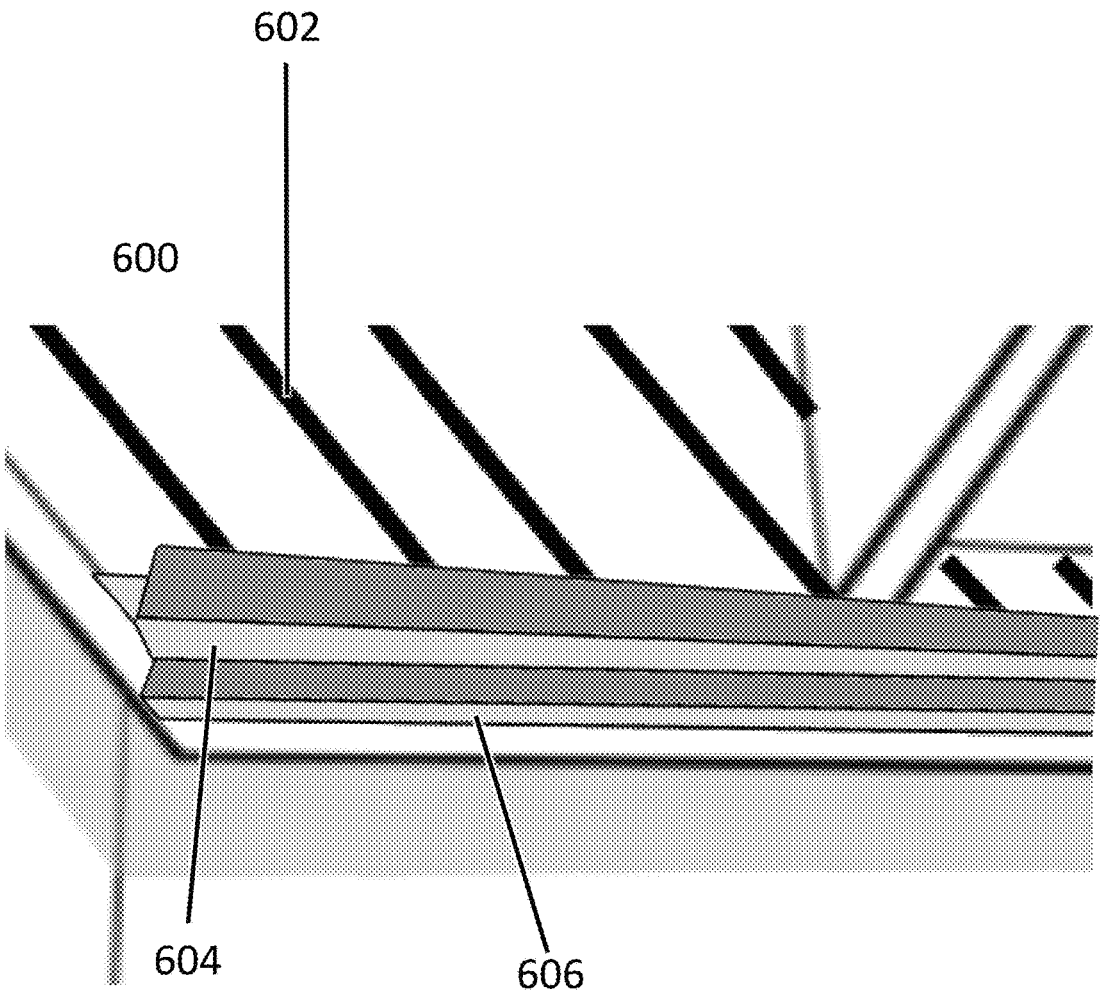
FIG. 12 is an exemplary embodiment of a snow guard as installed on a residential standing seam metal roof.

Turning now to exemplary FIG. 12, FIG. 12 may show an exemplary embodiment of a snow guard in use on a building, in particular on a residential standing seam metal roof 600. According to an exemplary embodiment, the standing seam metal roof 600 may have a plurality of standing seams 602 protruding upwards from it. The snow guard 604 may be coupled to the standing seams 602 such that the tail 606 of the snow guard, which may be created by providing a flanged corner in the lower base plate portion of the snow guard, extends outward from the standing seams 602 and runs essentially parallel to the plane of the standing seam metal roof. According to an exemplary embodiment, such an exemplary embodiment of a snow guard 604 may be used generally when the plurality of standing seams 602 are of a lower height, for example if they are one-inch standing seams 602 rather than one and one-half-inch standing seams 602; according to other exemplary embodiments, the standing seams 602 may be of any height, such as may be desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A snow guard attachable to a raised portion of a building surface, comprising:

an upper base plate, the upper base plate comprising a thickened edge portion formed from the material of the upper base plate and disposed along an upper edge of the upper base plate, the upper base plate further comprising a flange connection to an upper barrier plate disposed along a lower edge of the upper base plate;

the upper barrier plate comprising a first raised portion extending from the flange connection of the upper base plate at a first angle with a length of the upper base plate, a second raised portion having a flange connection to a lower base plate disposed along a lower edge of the second raised portion and extending from the flange connection of the lower base plate at a second angle with a length of the lower base plate, the second raised portion terminating in a flange connection to a lower barrier plate and further having a rounded edge connecting the second raised portion to the first raised portion;

the lower base plate comprising a flange connection to a lower barrier plate disposed along a lower edge of the lower base plate; and the lower barrier plate extending from the flange connection of the lower base plate in a direction at a third angle to the lower base plate, the lower barrier plate comprising a thickened edge portion formed from the material of the lower barrier plate and disposed along a lower edge of the lower barrier plate, wherein the length of the lower base plate is parallel to the length of the upper base plate.

2. The snow guard of claim 1, wherein the snow guard is formed from sheet metal;

wherein the thickened edge portion of the upper base plate comprises a layer of the upper base plate bent underneath the upper base plate to form an upper edge portion having at least twice the thickness of the upper base plate; and wherein the thickened edge portion of the lower barrier plate comprises a layer of the lower barrier plate bent underneath the lower barrier plate to form a lower edge portion having at least twice the thickness of the lower barrier plate.

3. The snow guard of claim 2, wherein the upper edge portion comprises at least one of a beaded edge, a flat-hemmed edge, an open-hemmed edge, or a multiple-hemmed edge.

4. The snow guard of claim 2, wherein the lower edge portion comprises at least one of a beaded edge, a flat-hemmed edge, an open-hemmed edge, or a multiple-hemmed edge.

5. The snow guard of claim 1, wherein each of the first angle, the second angle, and the third angle is substantially 90 degrees, such that a length of the upper barrier plate is perpendicular to both the upper base plate and lower base plate, and such that a length of the lower barrier plate is perpendicular to both the upper base plate and lower base plate and parallel with the upper barrier plate.

6. The snow guard of claim 1, wherein the upper base plate, the upper barrier plate, the lower base plate, and the lower barrier plate are formed from a single part and contiguously connected.

7. The snow guard of claim 1, wherein the upper base plate and the first raised portion of the upper barrier plate are formed as a first part and contiguously connected, wherein the lower barrier plate, the lower base plate, and the second raised portion are formed as a second part and contiguously connected, and wherein the first part and the second part are connected at a rounded edge of the upper barrier plate.

8. The snow guard of claim 1, wherein the rounded edge of the upper barrier plate is formed on the second raised portion and extends in the direction of the first raised portion, the rounded edge having an open hem so as to allow the first raised portion to be disposed under the rounded edge.

9. The snow guard of claim 8, wherein the first raised portion, the second raised portion, and the rounded edge of the upper barrier plate each have one or more connector holes through which a connector may be disposed, such that when the first raised portion is positioned under the rounded edge the connector holes of the first raised portion, the second raised portion, and the rounded edge of the upper barrier plate are aligned so as to allow a connector to simultaneously be disposed through a connector hole of the rounded edge of the upper barrier plate, a connector hole of the first raised portion, and a connector hole of the second raised portion.

10. The snow guard of claim 8, wherein the rounded edge of the upper barrier plate and the second raised portion are crimped together to secure the first raised portion.

11. The snow guard of claim 1, wherein at least one of the upper base plate and the lower base plate has at least one connector hole disposed therein.

12. A method for installing a snow guard, the snow guard comprising:

an upper base plate, the upper base plate comprising a thickened edge portion formed from the material of the upper base plate and disposed along an upper edge of the upper base plate, the upper base plate further comprising a flange connection to an upper barrier plate disposed along a lower edge of the upper base plate;

the upper barrier plate comprising a first raised portion extending from the flange connection of the upper base plate at a first angle with a length of the upper base plate, a second raised portion having a flange connection to a lower base plate disposed along a lower edge of the second raised portion and extending from the flange connection of the lower base plate at a second angle with a length of the lower base plate, the second raised portion terminating in a flange connection to a lower barrier plate and further having a rounded edge connecting the second raised portion to the first raised portion;

the lower base plate comprising a flange connection to a lower barrier plate disposed along a lower edge of the lower base plate; and the lower barrier plate extending from the flange connection of the lower base plate in a direction at a third angle to the lower base plate, the lower barrier plate comprising a thickened edge portion formed from the material of the lower barrier plate and disposed along a lower edge of the lower barrier plate;

wherein the method for installing said snow guard comprises:

aligning the snow guard with a standing seam of a roof such that the upper base plate and lower base plate are aligned parallel with the standing seam, the upper barrier plate extends outward away from the standing seam, and the lower barrier plate extends over an end of the standing seam; and installing a connector in at least one of the upper base plate and the lower base plate, said connector extending through the at least one of the upper base plate and the lower base plate and into the standing seam.

13. The method of claim 12, comprising:

installing a connector through a connector hole of the first raised portion, a connector hole of the second raised portion, and a connector hole of the upper barrier plate.

* * * * *